United States Patent [19]

Schmanski

[11] Patent Number: 4,779,955

[45] Date of Patent: Oct. 25, 1988

[54] 360 DEGREE REFLECTOR DEVICE

[75] Inventor: Donald W. Schmanski, Carson City, Nev.

[73] Assignee: Ametek, New York, N.Y.

[21] Appl. No.: 118,739

[22] Filed: Nov. 9, 1987

[51] Int. Cl.[4] ..... E01F 9/01; G02B 5/12

[52] U.S. Cl. ..... 350/97; 116/63 R; 248/156; 248/158; 404/9

[58] Field of Search ..... 116/63 R, 209; 248/156; 404/9; 350/97

[56] References Cited

U.S. PATENT DOCUMENTS

| | | | |
|---|---|---|---|
| 2,269,029 | 1/1942 | Lounsbery | 350/97 X |
| 2,834,133 | 5/1958 | Carmack | 116/63 R X |
| 3,066,577 | 12/1962 | Gunderson | 350/97 |
| 3,091,997 | 6/1963 | Byrd | 116/63 R |
| 3,851,615 | 12/1974 | Grundvig et al. | 404/9 X |
| 3,916,815 | 11/1975 | Valley | 116/63 P |

*Primary Examiner*—Daniel M. Yasich

*Attorney, Agent, or Firm*—Thorpe, North & Western

[57] ABSTRACT

A reflective device for providing 360 degrees of reflective surface to an attached support post having only forward and rearward faces suitable for viewing. The device comprises an elongate, hollow tubular body having a top rim, intermediate side wall and bottom rim. A closed top cover is coupled to the top rim and includes a recess which projects above the cover and is configured to provide a conformed fit around the upper end of the support post which is received therein. A slotted opening is positioned in the bottom cover which is coupled to the bottom rim and provides a port for inserting the post for seating within the 360 degree reflective structure.

7 Claims, 1 Drawing Sheet

360 DEGREE REFLECTOR DEVICE

BACKGROUND OF THE INVENTION

1. Field of the Invention

This invention relates to devices for providing 360 degrees of reflective surface for highway and field applications. More specifically, the present invention relates to a device for positioning at an upper end of a delineator, highway marker, or utility marker which otherwise offers only forward and rearward reflective surfaces, thereby modifying the existing marker to provide 360 degrees of observable surface.

2. Prior Art

A substantial variety of rigid marker or delineator devices has been developed which include the properties of having sufficient column strength to be drivable into the ground, yet which also provide sufficient flexibility within the marker structure to survive a lateral impact. For example, U.S. Pat. No. 32,045 discloses a highway marker which is substantially flat or slightly curved to provide forward and rearward reflective surfaces. This marker is positioned along roadsides or in open terrain to identify subsurface locations of water pipes, electric, gas and other utility lines, or for other delineation purposes.

Typical installation procedures for such drivable and flexible delineators include inserting the post or marker into a tubular or pipe driver, and then hammering the post into the ground by impacting the cap of the driver on the top of the marker. Once the marker is buried to a sufficient depth, the driver is removed and the post is exposed for providing delineation or other identification.

Often, one or both of the forward and rearward faces of the delineator have an attached reflector or lettered identification format. When used along a highway, the directions of travel provide appropriate viewing positioning of vehicles or observers, so that the forward-/rearward reflective surface positions are adequate. In field applications, however, where 360 degrees of viewing orientation are anticipated, the conventional flat markers may be inadequate. For example, for a pipeline traversing an open field, an overland vehicle may come from any direction. Such unpredictable orientations of approach require the ability to detect buried pipes and utility lines by observing markers from any direction.

OBJECTS AND SUMMARY OF THE INVENTION

It is therefore an object of the present invention to provide a device attachable at the top of the marker or post which converts the otherwise forward/rearward viewing faces to 360 degree viewing capability.

A further object of the present invention is to provide such a device that can be quickly and firmly attached to the top of the marker or post, yet which will not rotate or be easily displaced when the post is struck by a vehicle or other moving object.

A still further object of the present invention is to provide such a 360 degree viewing surface to a post or marker which gives an appearance of being a single structure with the post, rather than being a separate structure.

These and other objects are realized in a reflective device for positioning at the upper end of an attached support post having a uniform cross-sectional configuration including forward and rearward faces. The device includes a hollow, elongate, tubular body having a top rim, a bottom rim and an intermediate side wall. The tubular body has an inside diameter which is greater than the width of the post on which the device is supported. The top rim of the tubular body is closed by an attached top cover which includes a recess configured to provide a snug fit around the upper end of the support post. A bottom cover is coupled to the bottom rim of the tubular body and includes a slotted opening to enable insertion of the support post and to provide a substantially conformed fit around a lower, intermediate section of the support post. The top recess and bottom slotted opening are oriented along a common diagonal for proper alignment with the inserted post. When the device is attached to the top of the post, 360 degree visibility is enabled, providing an appropriate surface for positioning of reflector material, signs, etc.

Other object and features of the present invention will be apparent to those skilled in the art, in view of the following detailed description, taken in combination with the accompanying drawings.

DETAILED DESCRIPTION OF THE INVENTION

Figure 1:
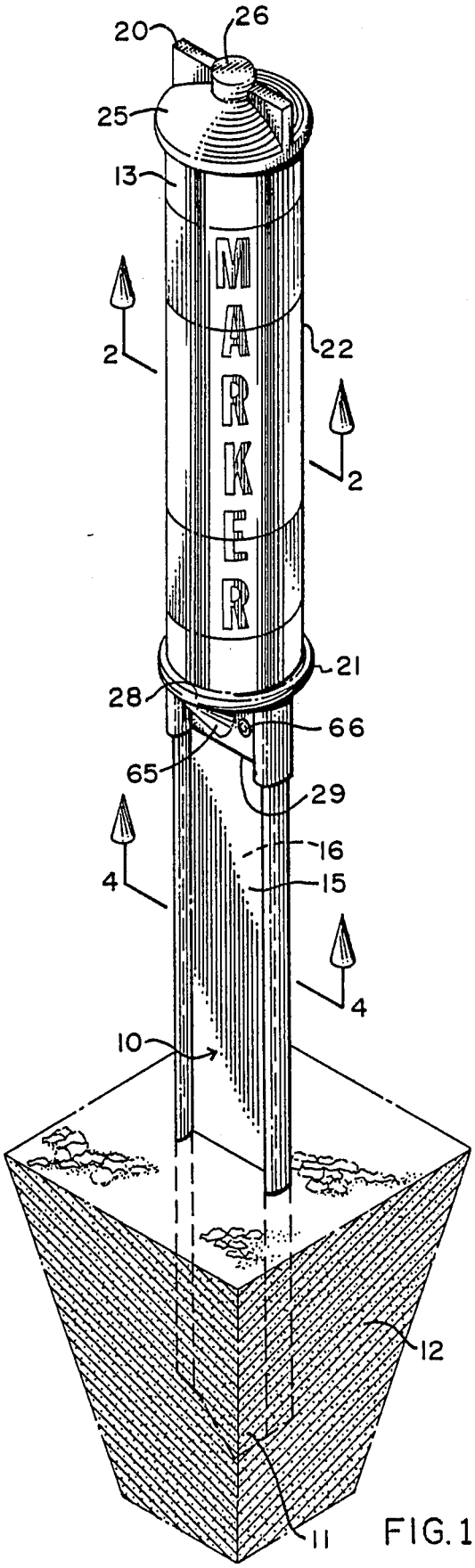
FIG. 1 shows a perspective view of a support post or marker with an attached reflector device in accordance with the present invention.
Figure 2:
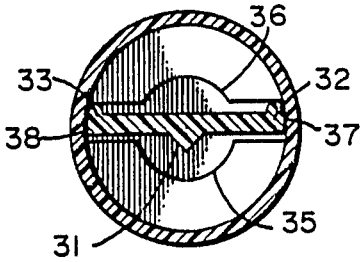
FIG. 2 depicts a cross-sectional view of the device of FIG. 1, taken along the lines 2—2.
Figure 3:
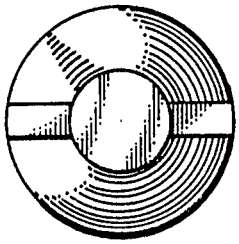
FIG. 3 illustrates a top view of the reflective device shown in FIG. 1.
Figure 4:
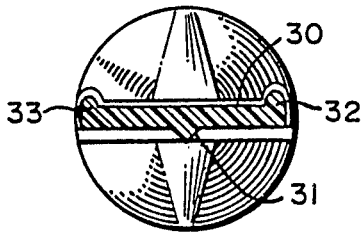
FIG. 4 illustrates a bottom view of the device, taken along the lines 4—4.

FIG. 1 illustrates a combination delineator or marker device which includes two components. The first component is a semi-rigid, deformable support post 10 which includes a base end 11 for insertion into the ground 12 and a top end which is concealed within a reflective device 13 constructed in accordance with the present invention. This post may be fabricated of any composition which provides sufficient column strength and stiffness to maintain the components in an upright and stable configuration. Such compositions may include fiber-reinforced plastics, non-reinforced plastics, or virtually any post which requires conversion of a marker having visibility from limited orientations, to a marker having 360 degrees of visibility. Such markers 10 are typically characterized by having forward 15 and rearward 16 faces suitable for mounting reflecting material or other signage.

These posts 10 are customarily driven into the ground with a post driver as was previously disclosed. In such instances, the top end of the post is impacted and bears the driving load. Once driven into the ground, the reflective device 13 is slid over the top of the post and nested in its seated configuration around the post structure.

This reflective device 13 includes a hollow, elongate, tubular body which has a top rim 20, a bottom rim 21 and an intermediate sidewall structure 22 therebetween. As can be seen in the remaining figures, the inner diameter within the side walls is greater than the width of the post being inserted therein.

Figure 5:
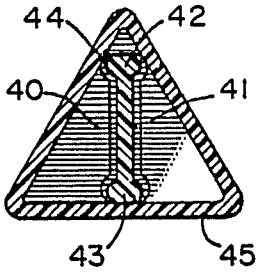
FIG. 5 illustrates another embodiment of the present invention, illustrated as a cross-section similir to that shown in FIG. 2, as viewed along the lines 2—2.
Figure 6:
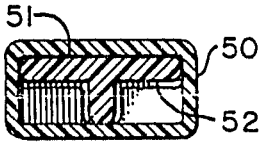
FIGS. 6 and 7 illustrate other embodiments of the present invention, illustrated as a cross-section similar to that shown in FIG. 2, as viewed along the lines 2—2.
Figure 7:
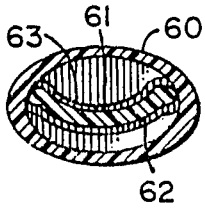

A top cover 25 functions to close the tubular body and is coupled to the top rim. The top cover also provides a recess or cavity 26 for receiving the top end of the contained marker or post. This recess 26 represents a projecting structure which extends above the cover and is closed to contain and protect the interior. The interior of the top cover includes an inside opening which is oriented toward an interior portion of the tubular body and is configured to provide a snug or conformed fit around the upper end of the support post as illustrated in the figures. The projecting structure and opening may be rectangular with appropriate dimensions as shown in FIGS. 1–4, or may be configured to more precisely conform to the geometry of the post as shown in FIGS. 5–7. This snug or conformed fit enables securing the post to the tubular body and preventing rotation of the device out of position. Typically, this recess extends at least one centimeter above the top rim.

The device also includes a partially open bottom cover 28 which includes a slotted opening 28 configured to provide a substantially conformed fit around a lower, intermediate section of the support post. As illustrated, this bottom slotted opening is oriented along a common diagonal with the recess 26 of the top cover. The slotted opening provides an access port for inserting the upper end of the post into the tubular body and into the nesting position within the recess of the top cover.

The subject tubular reflector may be configured to fit a variety of post structures. For example, the post illustrated in FIGS. 1–4 is a post having a substantially flat and partially ribbed forward face 30 and a ribbed rearward face 31. In addition, lateral ribs 32 and 33 extend slightly forward. FIGS. 1–4 illustrate a top cover recess which is configured with a flat forward face 35 and a similar flat rearward face 36 with flat lateral side structure 37 and 38. The rectangular construction of this recess is slightly larger in size than the extremity surfaces of the post to provide a snug fit when in the seated configuration.

FIG. 5 illustrates a post having forward and rearward faces which are flat 40 and 41, with lateral ribs 42 and 43. In this instance, the top cover recess 44 is structured to conform more exactly to an I-shaped configuration. The triangular cross-section of the tubular member 45 illustrates the variety of shapes which can be adopted to fit a particular post configuration. FIG. 6 illustrates another embodiment comprised of a rectangular tubular member 50 which encloses a T-shaped marker 51. Again, the top recess 52 is structured to conform to the T shape on the post inserted therein. An elliptical cross-section 60 is illustrated in FIG. 7, and houses a marker having a forward concave 61 face and a rearward 62 convex face. Here again, the top recess 63 is configured in the concaval/convex shape to provide a conformed fit. The lower slotted opening in each instance may be conformed as the top recess, or alternatively, may merely be a slot which is rectangularly configured to receive the post cross-section.

A reinforcement section 65 may be positioned at each side of the bottom cover as illustrated. This section 65 provides strength to the tubular body and bottom cover to recover from impacts by vehicles or other moving objects. In the preferred embodiment, they are formed as projecting channel structures oriented at right angles to the respective forward an rearward faces of the post. Rivets 66 may be applied through openings at the base of the device and through the post to secure it in place and to prevent theft.

It will be apparent that other geometries and constructions may be applied to the present invention. Accordingly, it is to be understood that the scope of invention is not to be limited by specific examples provided herein, but is to be defined by the following claims.

I claim:

1. A reflective device for providing 360 degrees of reflective surface to an upper end of an attached, upright, support post having a uniform cross-sectional configuration including forward and rearward faces comprising more than 80 per cent of the perimeter of the post, said device comprising:

a hollow, elongate, tubular body having a top rim, a bottom rim and an intermediate sidewall therebetween, said tubular body having an inside diameter within the sidewall which is greater than the width of the post said tubular body carrying reflective means therearound;

a closed top cover coupled to the top rim of the tubular body, said top cover including a recess projecting above the cover and having an open side oriented toward an interior portion of the tubular body, said recess being configured to provide a conformed fit around the upper end of the support post sufficient to inhibit rotation of the tubular body;

a partially open bottom cover coupled to the bottom rim of the tubular body, said cover including a slotted opening configured to provide a substantially conformed fit around a lower, intermediate section of the support post and being oriented along a common diagonal with the top cover recess;

said slotted opening providing an access post for inserting the upper end of the post through the tubular body and into the recess of the top cover.

2. A reflective device as defined in claim 1, wherein the forward and rearward faces of the post are concave and convex respectively and the recess of the top cover and slotted opening are configured with a similar concave/convex structure.

3. A reflective device as defined in claim 1, wherein the forward and rearward faces of the post are respectively flat and ribbed and the recess of the top cover and slotted opening are configured with a similar flat/ribbed structure.

4. A reflective device as defined in claim 1, wherein the forward and rearward faces of the post are flat with ribbed sides to form an I-shaped cross-section and the recess of the top cover and slotted opening are configured with a similar I-shaped structure.

5. A reflective device as defined in claim 1, wherein the tubular body is configured with a circular cross-section.

6. A reflective device as defined in claim 1, wherein the top cover recess projects at least 1 cm above the top rim.

7. A reflective device as defined in claim 1, said reflective means further comprising reflective sheeting attached at an exterior surface of the tubular member.

* * * * *